US010044110B2

(12) United States Patent
Dong et al.

(10) Patent No.: US 10,044,110 B2
(45) Date of Patent: Aug. 7, 2018

(54) ANTENNAS WITH SHARED GROUNDING STRUCTURE

(71) Applicant: QUALCOMM Incorporated, San Diego, CA (US)

(72) Inventors: Yuandan Dong, San Diego, CA (US); Guining Shi, San Diego, CA (US); Allen Minh-Triet Tran, San Diego, CA (US)

(73) Assignee: QUALCOMM Incorporated, San Diego, CA (US)

( * ) Notice: Subject to any disclaimer, the term of this patent is extended or adjusted under 35 U.S.C. 154(b) by 169 days.

(21) Appl. No.: 13/932,105

(22) Filed: Jul. 1, 2013

(65) Prior Publication Data

US 2015/0002359 A1 Jan. 1, 2015

(51) Int. Cl.

| | |
|---|---|
| ***H01Q 21/00*** | (2006.01) |
| ***H01Q 1/24*** | (2006.01) |
| ***H01Q 1/48*** | (2006.01) |
| ***H01Q 1/52*** | (2006.01) |
| ***H01Q 21/28*** | (2006.01) |

(52) U.S. Cl.

CPC ..... *H01Q 21/0006* (2013.01); *H01Q 1/243* (2013.01); *H01Q 1/48* (2013.01); *H01Q 1/521* (2013.01); *H01Q 21/28* (2013.01); *Y10T 29/49016* (2015.01)

(58) Field of Classification Search

CPC ..... H01Q 21/0006
USPC ..... 343/853
See application file for complete search history.

(56) References Cited

U.S. PATENT DOCUMENTS 7,557,761 B2 * 7/2009 Iwai ..... H01Q 9/30 343/702
7,855,696 B2 * 12/2010 Gummalla ..... H01Q 1/243 342/359
8,279,121 B2 * 10/2012 Ishizuka ..... H01Q 1/243 343/700 MS (Continued)

FOREIGN PATENT DOCUMENTS

CN 101821902 A 9/2010
CN 102969568 A 3/2013

(Continued)

OTHER PUBLICATIONS

International Search Report and Written Opinion—PCT/US2014/043017—ISA/EPO—dated Oct. 1, 2014, 10 pages.

*Primary Examiner* — Dameon E Levi
*Assistant Examiner* — Walter Davis
(74) *Attorney, Agent, or Firm* — Qualcomm Incorporated—Toler

(57) ABSTRACT

Techniques for providing multiple antennas in a wireless device using a compact configuration to achieve good isolation and broad bandwidth. In an aspect, first and second monopole elements that may be separately driven are provided on opposite sides of a grounding strip conductively coupled to a common grounding structure. By capacitively coupling the first and second monopole elements to the common grounding structure, the effective resonator size of each monopole antenna is increased, thus achieving better performance for the antenna structure. Illustrative patterns for the common grounding structure and other antenna elements are further disclosed.

20 Claims, 12 Drawing Sheets

(56) References Cited

U.S. PATENT DOCUMENTS

| | | | | |
|---|---|---|---|---|
| 8,373,604 | B2 | 2/2013 | Wong et al. | |
| 2008/0258992 | A1* | 10/2008 | Tsai | H01Q 1/2266 343/853 |
| 2010/0069117 | A1* | 3/2010 | Knighton | H04M 1/0274 455/557 |
| 2011/0199272 | A1* | 8/2011 | He | H01Q 1/243 343/741 |
| 2012/0299785 | A1* | 11/2012 | Bevelacqua | H01Q 9/42 343/702 |
| 2013/0002497 | A1 | 1/2013 | Hamabe | |
| 2013/0050027 | A1 | 2/2013 | Kim et al. | |
| 2013/0050031 | A1 | 2/2013 | Zhu et al. | |

FOREIGN PATENT DOCUMENTS

| | | | |
|---|---|---|---|
| EP | 1892798 | A1 | 2/2008 |
| JP | 2007524310 | A | 8/2007 |
| JP | 2012178810 | A | 9/2012 |
| JP | 2014068233 | A | 4/2014 |
| WO | 2008081077 | A1 | 7/2008 |
| WO | 2010028521 | A1 | 3/2010 |
| WO | 2013010145 | A1 | 1/2013 |
| WO | 2013077302 | A1 | 5/2013 |

* cited by examiner

ANTENNAS WITH SHARED GROUNDING STRUCTURE

BACKGROUND

Field

The disclosure relates to antennas for wireless communications devices.

Background

State-of-the-art wireless communications devices such as smart phones often require broadband antennas to accommodate multiple frequency bands, e.g., as dictated by the long-term evolution (LTE) system and other existing wireless wide area network (WWAN) mobile networks. For example, current fourth generation (4G) LTE smart phones are typically required to support a plurality of frequency bands, including LTE 700 (698-787 MHz), GSM 850 (824-894 MHz), GSM 900 (880-960 MHz), etc., in addition to other bands such as the global positioning system (GPS) band (1.575 GHz). In some implementations, a wireless device may be required to process radio signals over as many as eight or nine frequency bands, or more.

To support such multiple frequency bands, wireless devices may employ antennas operating over two or more broad bands that collectively cover the above-mentioned frequency bands, e.g., a low broad band spanning 700 MHz-960 MHz and a high broad band spanning 1710 MHz-2690 MHz. Per techniques of antenna design, a small antenna size usually corresponds to narrow bandwidth and low radiation efficiency. Accordingly, to accommodate such a broad bandwidth, each antenna requires a minimum volume or clearance, which mandates a minimum size for the design. In another aspect of modern wireless devices, multiple antennas are required to implement a feature known as multiple-input multiple-output (MIMO) to enhance wireless channel capacity.

To accommodate the aforementioned features, a wireless device may typically be required to include two or more antennas. However, due to the continuing trends toward reduction of phone size, optimization of industry design (ID), and the increase of function, very limited internal space within the wireless device is left for the antennas. These considerations complicate the design of LTE/MIMO antennas for wireless devices, as antennas must be provided in a restricted small space while nevertheless exhibiting sufficiently large bandwidth and radiation performance.

It would thus be desirable to provide techniques for design multiple antennas for a wireless device having sufficient bandwidth and performance with relatively small physical dimensions.

DETAILED DESCRIPTION

Various aspects of the disclosure are described more fully hereinafter with reference to the accompanying drawings. This disclosure may, however, be embodied in many different forms and should not be construed as limited to any specific structure or function presented throughout this disclosure. Rather, these aspects are provided so that this disclosure will be thorough and complete, and will fully convey the scope of the disclosure to those skilled in the art. Based on the teachings herein one skilled in the art should appreciate that the scope of the disclosure is intended to cover any aspect of the disclosure disclosed herein, whether implemented independently of or combined with any other aspect of the disclosure. For example, an apparatus may be implemented or a method may be practiced using any number of the aspects set forth herein. In addition, the scope of the disclosure is intended to cover such an apparatus or method which is practiced using other structure, functionality, or structure and functionality in addition to or other than the various aspects of the disclosure set forth herein. It should be understood that any aspect of the disclosure disclosed herein may be embodied by one or more elements of a claim.

The detailed description set forth below in connection with the appended drawings is intended as a description of exemplary aspects of the invention and is not intended to represent the only exemplary aspects in which the invention can be practiced. The term "exemplary" used throughout this description means "serving as an example, instance, or illustration," and should not necessarily be construed as preferred or advantageous over other exemplary aspects. The detailed description includes specific details for the purpose of providing a thorough understanding of the exemplary aspects of the invention. It will be apparent to those skilled in the art that the exemplary aspects of the invention may be practiced without these specific details. In some instances, well-known structures and devices are shown in block diagram form in order to avoid obscuring the novelty of the exemplary aspects presented herein. In this specification and in the claims, the terms "module" and "block" may be used interchangeably to denote an entity configured to perform the operations described.

Figure 1:
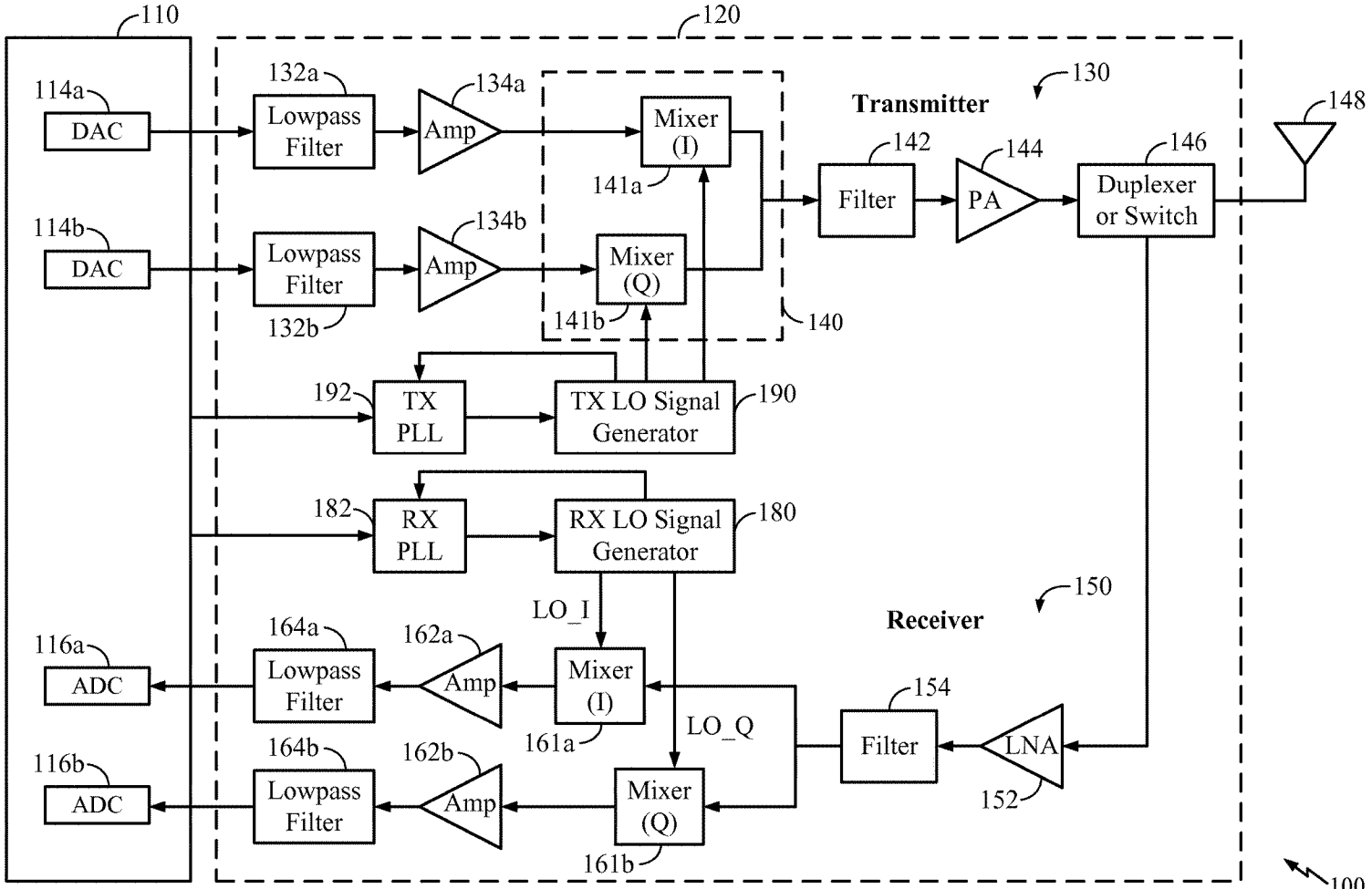
(PRIOR ART) FIG 1
FIG. 1 illustrates a block diagram of a design of a prior art wireless communication device 100 in which the techniques of the present disclosure may be implemented.

FIG. 1 illustrates a block diagram of a design of a prior art wireless communication device 100 in which the techniques of the present disclosure may be implemented. FIG. 1 shows an example transceiver design. In general, the conditioning of the signals in a transmitter and a receiver may be performed by one or more stages of amplifier, filter, upconverter, downconverter, etc. These circuit blocks may be arranged differently from the configuration shown in FIG. 1. Furthermore, other circuit blocks not shown in FIG. 1 may also be used to condition the signals in the transmitter and receiver. Unless otherwise noted, any signal in FIG. 1, or any other figure in the drawings, may be either single-ended or differential. Some circuit blocks in FIG. 1 may also be omitted.

In the design shown in FIG. 1, wireless device 100 includes a transceiver 120 and a data processor 110. The data processor 110 may include a memory (not shown) to store data and program codes. Transceiver 120 includes a transmitter 130 and a receiver 150 that support bi-directional communication. In general, wireless device 100 may include any number of transmitters and/or receivers for any number of communication systems and frequency bands. All or a portion of transceiver 120 may be implemented on one or more analog integrated circuits (ICs), RF ICs (RFICs), mixed-signal ICs, etc.

A transmitter or a receiver may be implemented with a super-heterodyne architecture or a direct-conversion architecture. In the super-heterodyne architecture, a signal is frequency-converted between radio frequency (RF) and baseband in multiple stages, e.g., from RF to an intermediate frequency (IF) in one stage, and then from IF to baseband in another stage for a receiver. In the direct-conversion architecture, a signal is frequency converted between RF and baseband in one stage. The super-heterodyne and direct-conversion architectures may use different circuit blocks and/or have different requirements. In the design shown in FIG. 1, transmitter 130 and receiver 150 are implemented with the direct-conversion architecture.

In the transmit path, data processor 110 processes data to be transmitted and provides I and Q analog output signals to transmitter 130. In the exemplary embodiment shown, the data processor 110 includes digital-to-analog-converters (DAC's) 114*a* and 114*b* for converting digital signals generated by the data processor 110 into the I and Q analog output signals, e.g., I and Q output currents, for further processing.

Within transmitter 130, lowpass filters 132*a* and 132*b* filter the I and Q analog output signals, respectively, to remove undesired images caused by the prior digital-to-analog conversion. Amplifiers (Amp) 134*a* and 134*b* amplify the signals from lowpass filters 132*a* and 132*b*, respectively, and provide I and Q baseband signals. An upconverter 140 upconverts the I and Q baseband signals with I and Q transmit (TX) local oscillator (LO) signals from a TX LO signal generator 190 and provides an upconverted signal. A filter 142 filters the upconverted signal to remove undesired images caused by the frequency upconversion as well as noise in a receive frequency band. A power amplifier (PA) 144 amplifies the signal from filter 142 to obtain the desired output power level and provides a transmit RF signal. The transmit RF signal is routed through a duplexer or switch 146 and transmitted via an antenna 148.

In the receive path, antenna 148 receives signals transmitted by base stations and provides a received RF signal, which is routed through duplexer or switch 146 and provided to a low noise amplifier (LNA) 152. The duplexer 146 is designed to operate with a specific RX-to-TX duplexer frequency separation, such that RX signals are isolated from TX signals. The received RF signal is amplified by LNA 152 and filtered by a filter 154 to obtain a desired RF input signal. Downconversion mixers 161*a* and 161*b* mix the output of filter 154 with I and Q receive (RX) LO signals (i.e., LO_I and LO_Q) from an RX LO signal generator 180 to generate I and Q baseband signals. The I and Q baseband signals are amplified by amplifiers 162*a* and 162*b* and further filtered by lowpass filters 164*a* and 164*b* to obtain I and Q analog input signals, which are provided to data processor 110. In the exemplary embodiment shown, the data processor 110 includes analog-to-digital-converters (ADC's) 116*a* and 116*b* for converting the analog input signals into digital signals to be further processed by the data processor 110.

In FIG. 1, TX LO signal generator 190 generates the I and Q TX LO signals used for frequency upconversion, while RX LO signal generator 180 generates the I and Q RX LO signals used for frequency downconversion. Each LO signal is a periodic signal with a particular fundamental frequency. A PLL 192 receives timing information from data processor 110 and generates a control signal used to adjust the frequency and/or phase of the TX LO signals from LO signal generator 190. Similarly, a PLL 182 receives timing information from data processor 110 and generates a control signal used to adjust the frequency and/or phase of the RX LO signals from LO signal generator 180.

In certain implementations (not shown in FIG. 1), a balun may be provided between the output of the LNA 152 and the mixers 161*a*, 161*b* of the receiver 150. The balun may convert a single-ended signal to a differential signal, and may include, e.g., a transformer that mutually couples a signal from a primary winding to a secondary winding. Furthermore, in certain alternative implementations not shown, a plurality of LNA's 152 may be provided, wherein each LNA is optimized to process an input RF signal in a particular frequency band.

In certain implementations, more than one antenna 148 may be provided to accommodate certain wireless techniques, e.g., multiple-input multiple-output (MIMO) or diversity applications, in a phone. In such implementations, the multiple antennas may occupy a substantial amount of space in the phone, e.g., one primary antenna on a bottom surface of the phone, and one diversity antenna on the top of the phone. Alternatively, two antennas may be provided side by side on the bottom surface of the phone, which reduces the overall antenna size, but may undesirably compromise the performance. Due to strict form factor limitations in modern wireless devices, many designers opt to limit antenna bandwidth, or otherwise sacrifice antenna performance, for the sake of providing antennas that consume less area in a device.

The present disclosure provides techniques for designing dual or more antennas having improved radiation efficiency across a wide bandwidth, while consuming less area in a wireless device compared to prior art techniques.

Figure 2:
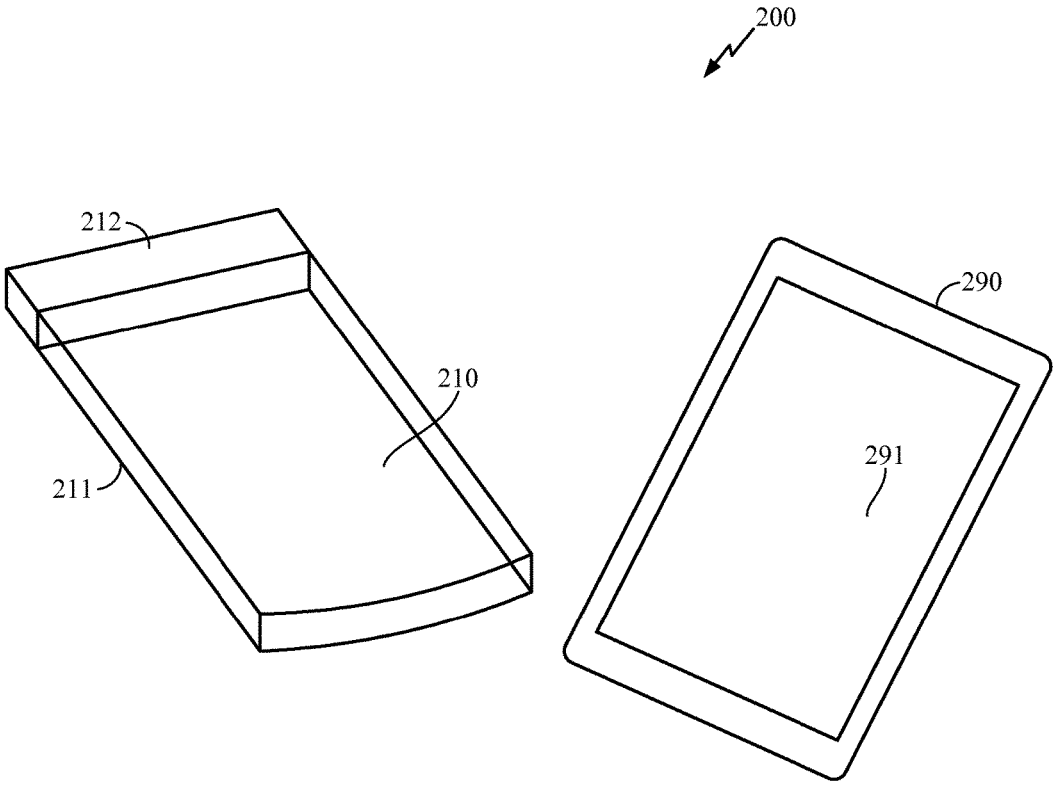
FIG. 2 illustrates an exemplary embodiment of an apparatus accommodating multiple antennas according to the present disclosure.

FIG. 2 illustrates parts of an apparatus 200 accommodating multiple antennas according to the present disclosure. Note the parts shown in FIG. 2 are provided for illustrative purposes only, and is not mean to limit the scope of the present disclosure. For example, as will be further described hereinbelow with reference to the other figures, disclosure, and the claims, alternative exemplary embodiments may incorporate alternative configurations, e.g., different from what is explicitly shown in FIG. 2.

In FIG. 2, components of an apparatus 200, e.g., a mobile phone, are illustrated to highlight certain aspects of the present disclosure. In particular, a front surface 290 of the apparatus 200, e.g., incorporating a screen 291 (e.g., touch screen or other type of screen), is shown detached from the body 211 of the apparatus 200. Provided at one end, e.g., an upper end or lower end, of the body 211 of the phone is a substrate 212. In an exemplary embodiment, the substrate 212 may be an FR-4 substrate known in the art. In an exemplary embodiment, the substrate 212 may provide supporting structure to hold in place the antenna elements further described hereinbelow. In certain exemplary embodiments, the substrate 212 may have a hollow shape, and additional elements (not shown) of the apparatus 200 may be provided in space defined by such hollow shape of the substrate 212. The body 211 of the phone further supports a ground plane 210 that may be a flat horizontal conducting surface, and/or substantially physically co-extensive with a large surface area of the body 211 of the apparatus 200.

Figure 3:
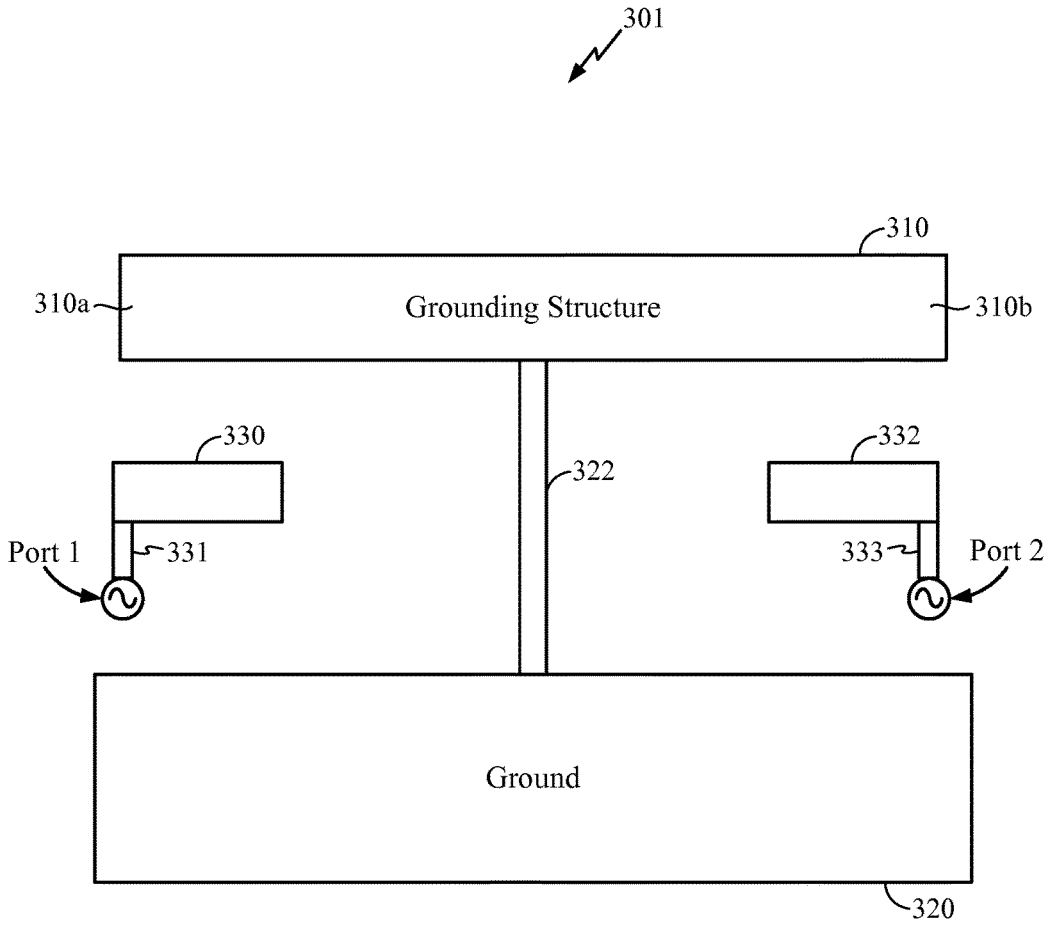
FIG. 3 illustrates an exemplary embodiment of an antenna structure according to the present disclosure.

FIG. 3 illustrates an exemplary embodiment of an antenna structure 301 according to the present disclosure. Note the antenna apparatus structure 301 is shown for illustrative purposes only, and is not meant to limit the scope of the present disclosure. It will be appreciated that integration of the elements of the antenna structure 301 with the rest of a wireless device, e.g., the apparatus 200 such as shown in FIG. 2, will be clear to one of ordinary skill in the art in light of the further disclosure hereinbelow, e.g., with reference to FIGS. 4-8.

In FIG. 3, the antenna structure 301 includes first and second monopole (antenna) elements 330, 332. The first monopole element 330 is coupled by a short conductive strip 331 to a driving terminal, also denoted Port 1 in FIG. 3. The second monopole element 332 is coupled by a short conductive strip 333 to a driving terminal Port 2. The two monopole elements 330, 332, may have design specifications that are independent of each other, and may correspond to, e.g., a primary antenna and a secondary antenna, respectively. It will be appreciated that the primary and secondary antennas may be driven by, e.g., independent signals, depending on the application.

In certain exemplary embodiments, the two monopole elements 330, 332 may be partially responsible for the high band radiation of the antenna. For example, in an exemplary embodiment, a primary monopole element may be designed to cover a frequency range of 700-960 MHz and 1710-2170 MHz with a gain of −4 dB, while a diversity monopole element may be designed to cover a frequency band of 734-960 MHz and 1805-2170 MHz with a gain of −7 dB.

Each of the monopole elements 330, 332 is capacitively coupled to a common or shared grounding structure 310 (also denoted herein as the "common structure"). The grounding structure 310 is conductively coupled via a grounding strip 322 (also denoted herein as a "connecting strip") to a ground element (or ground plane) 320. In an exemplary embodiment, the ground plane 320 may correspond to the ground plane 210 in FIG. 2. Note the grounding structure 310, grounding strip 322, and ground element 320 are all conductors, and mutually conductively coupled to each other. The common grounding structure 310 may include two branches 310*a* and 310*b*, with 310*a* being in closer physical proximity to first monopole element 330, and 310*b* being in closer physical proximity to second monopole element 332. Accordingly, branch 310*a* will be understood as being capacitively coupled to first monopole element 330, while branch 310*b* will be understood as being capacitively coupled to the second monopole element 332.

Note the demarcation in FIG. 3 of the grounding structure into two branches 310*a* and 310*b* is made for descriptive purposes only. In a practical implementation, no actual physical demarcation need be present between branches 310*a*, 310*b*, as it will be appreciated that all portions of the grounding structure 310 are conductively coupled to each other to form a single conductive element.

By conductively coupling the first branch 310*a* associated with the first monopole element 330 to the second branch 310*b* associated with the second monopole element 332, the two monopole elements 330, 332 effectively share a single grounding structure 310. It will be appreciated that the increased resonator size decreases the quality factor of the resonance and increases the bandwidth, especially at lower frequencies. (Note a "resonator" structure may be defined herein as corresponding to the combination of 330, 322, 310 for Port 1 excitation, and 332, 322, and 310 for Port 2 excitation.) Providing the shared grounding structure 310 thus advantageously increases the effective size of each monopole antenna, compared to, e.g., alternative implementations wherein a ground structure associated with the first monopole element 330 is physically separated from a ground structure associated with the second monopole element 332. It will be appreciated that increasing the effective size of the monopole antennas improves their radiation performance, while attaining relatively wide bandwidth for both of the monopole elements 330, 332 given the compact physical dimensions of the structure.

In an exemplary embodiment, a "one port excitation" scheme may be applied, wherein only one of the two monopole elements 330, 332 is driven at any time. When one of the monopole elements 330, 332 is driven by an active signal, it is expected that the grounded branch 310*a* or 310*b* in closer physical proximity to the driven monopole element will resonate strongly, with weaker coupling to the non-driven monopole element. For example, if Port 1 drives element 330 while Port 2 does not drive element 332, then only the branch 310*a* of the grounding structure 310 is expected to resonate strongly, while the branch 310*b* is expected to resonate only weakly.

In an exemplary embodiment, the conductive strip 322 coupling the shared grounding structure 310 to the ground plane 320 is provided between the monopole elements 330, 332. For example, per one exemplary definition, if a "connecting axis" (not shown in FIG. 3) is defined as connecting a point on the first monopole element 330 with a point on the second monopole element 332, then points on the ground strip 322 will generally have coordinates along such connecting axis that lie between the coordinates corresponding to the first and second monopole elements 330 and 332. Note this exemplary definition of a "connecting axis" is given for illustrative purposes only, and one of ordinary skill in the art may readily derive alternative definitions of the placement of the grounding strip 322 "between" the first and second monopole elements 330 and 332.

In an exemplary embodiment, the grounding structure 310 is large relative to the monopole elements 330, 332, and may additionally shield the monopole elements 330, 332 from, e.g., an external portion of the apparatus 200 (not shown in FIG. 2). The relatively large size of the grounding structure 310 may further protect the input/output signal lines feeding monopole elements 330, 332 through Port 1 and Port 2, respectively, from damage due to electrostatic discharge (ESD).

In an exemplary embodiment, a substrate 212 (not shown in FIG. 3), e.g., an FR-4 substrate, may be provided in the spacing between the conductive elements of the antenna 301, as mentioned hereinabove with reference to FIG. 2.

Figure 4:
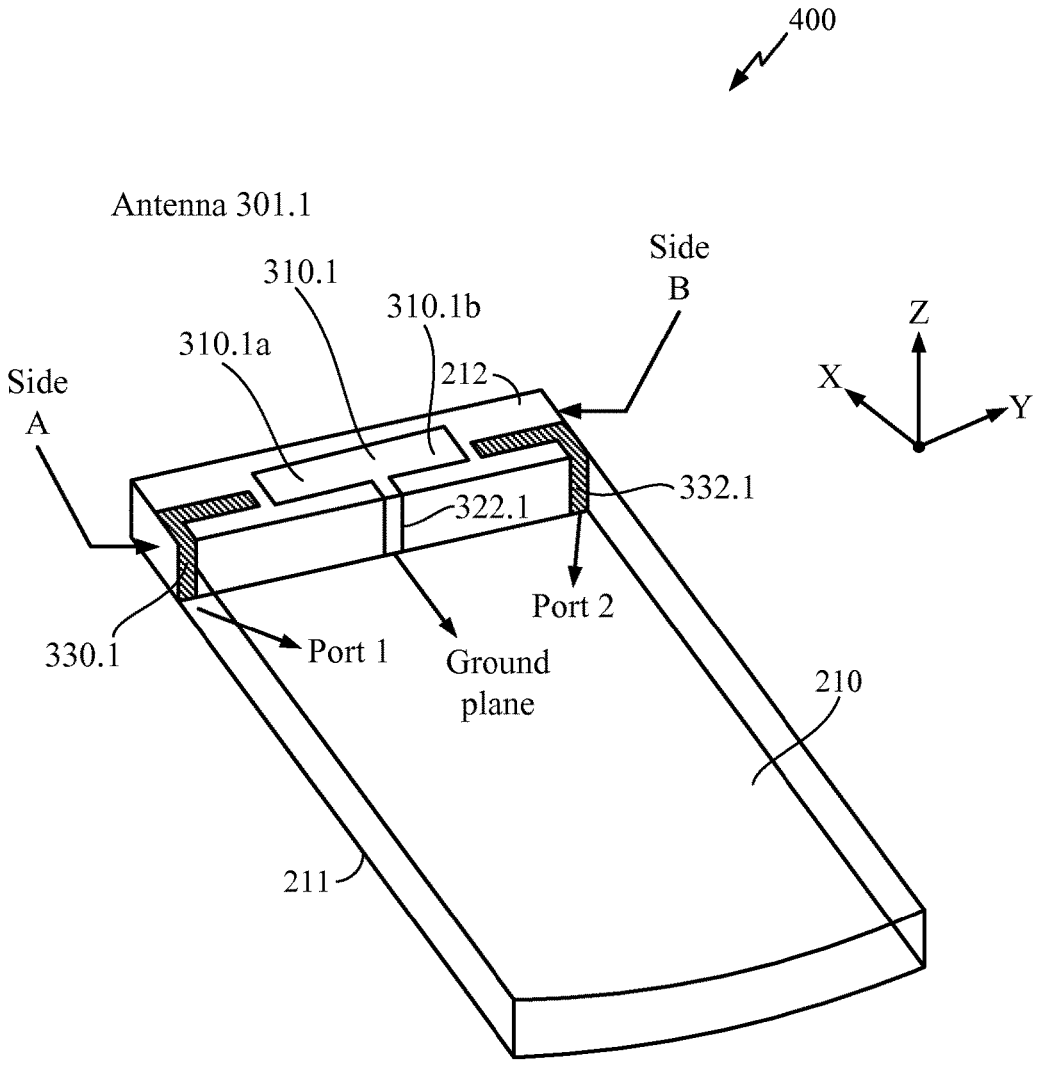
FIG. 4 illustrates an exemplary embodiment of an apparatus showing antenna elements integrated with a mobile device according to the present disclosure.

FIG. 4 illustrates an exemplary embodiment of an apparatus 400 showing antenna elements integrated with a mobile device according to the present disclosure. Note FIG. 4 is shown for illustrative purposes only, and is not meant to limit the scope of the present disclosure. It will be appreciated that certain elements in FIG. 4, and in the rest of the figures, having numerical identifiers in common with elements of FIG. 3 may have similar functionality, unless otherwise noted. For example, the grounding structure 310.1 in FIG. 4 may have similar functionality to that described for the grounding structure 310 in FIG. 3, etc.

In FIG. 4, the apparatus 400 with an antenna 301.1 includes first and second monopole elements 330.1, 332.1 driven by Port 1, Port 2, respectively. A grounding structure 310.1 is capacitively coupled to both the first and second monopole elements 330.1, 332.1. A grounding strip 322.1 conductively couples the grounding structure 310.1 to a ground plane 210 of the apparatus 400.

In the exemplary embodiment shown, the monopole elements 330.1, 332.1 are placed on opposite sides Side A and Side B of the apparatus 400. It will be appreciated that such placement of the monopole elements 330.1, 332.1 may advantageously increase their isolation from each other.

In an exemplary embodiment, the antenna 301.1 has a clearance to ground (e.g., extent along the Z-axis) of 8.5 mm, a thickness (e.g., extent along the X-axis) of 4.6 mm, and a board width (e.g., extent along the Y-axis) of 68.5 mm. Note the specific dimensions are given for illustrative purposes only, and are not meant to limit the scope of the present disclosure. By providing the elements of the antenna 301.1 as shown, dual or possibly more antennas may be supported in a relatively compact volume of the apparatus 400.

While the exemplary embodiment 400 shows parts of the monopole elements 330.1, 332.1 and the grounding structure 310.1 disposed adjacent a top surface of the apparatus 400 (e.g., a surface closer to the front cover 290 as shown in FIG. 2), in alternative exemplary embodiments, the monopole elements 330.1, 332.1 and grounding structure 310.1 may readily be disposed adjacent a bottom surface of the apparatus 400 instead. Such alternative exemplary embodiments are contemplated to be within the scope of the present disclosure.

Figure 5A:
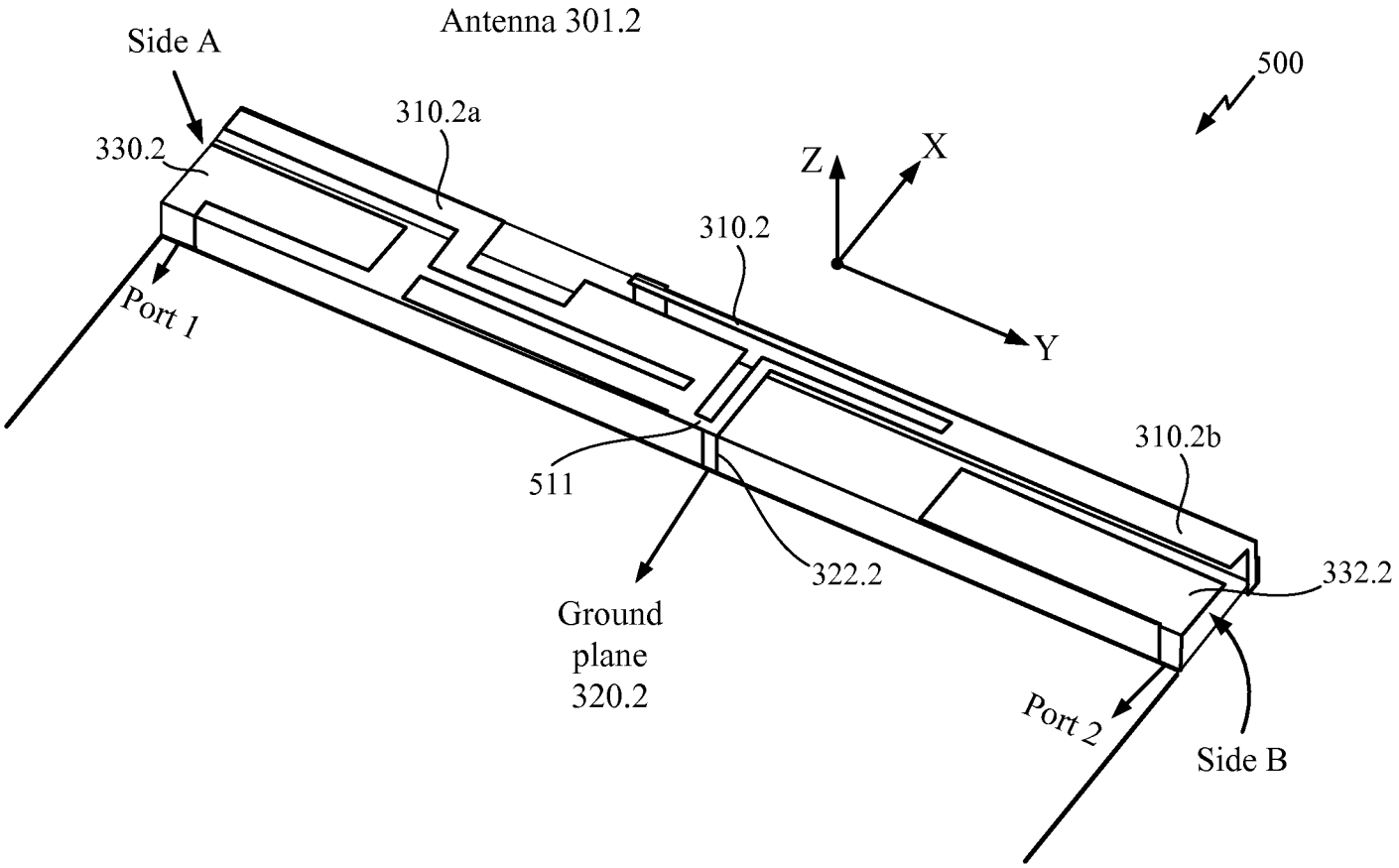
FIGS. 5A and 5B illustrate perspective views of an alternative exemplary embodiment of an antenna according to the present disclosure.
Figure 5B:
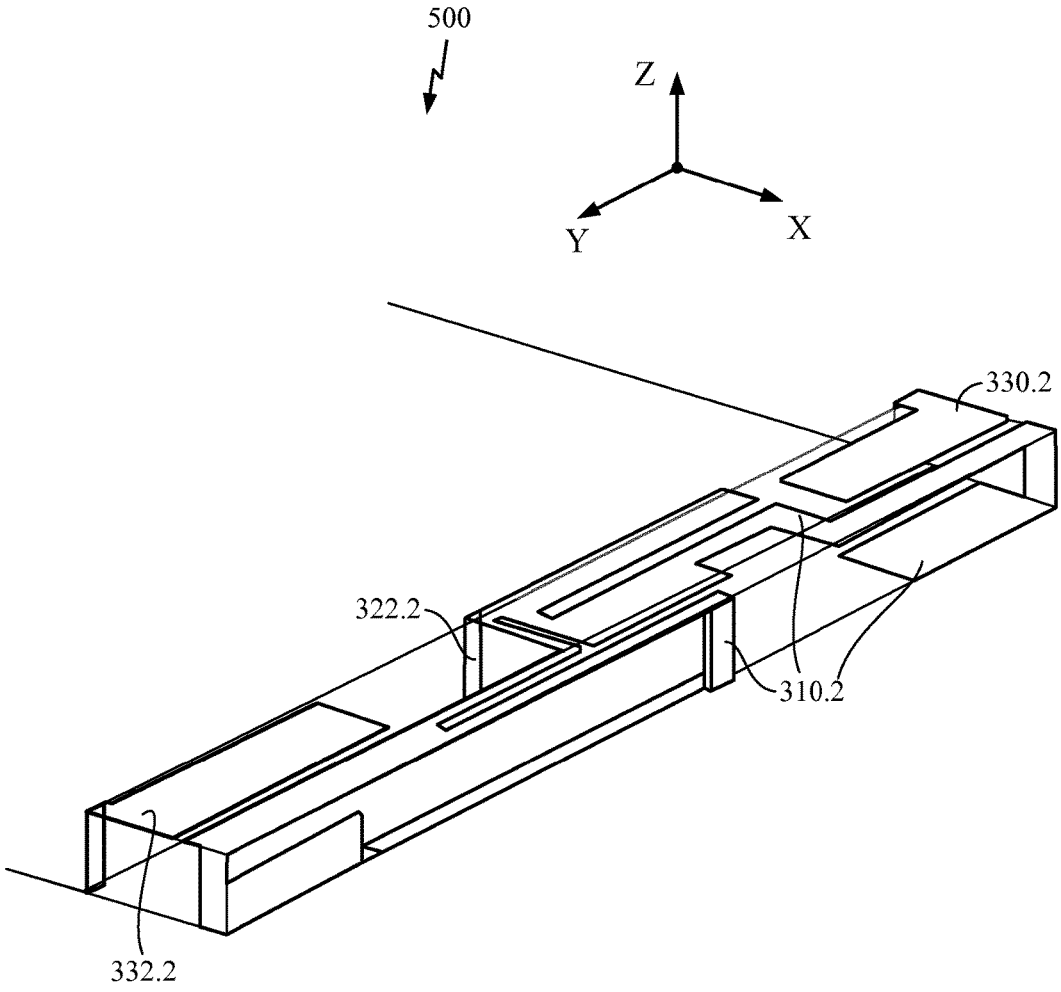

FIGS. 5A and 5B illustrate perspective views of an alternative exemplary embodiment of an antenna 301.2 according to the present disclosure. Note FIGS. 5A and 5B are shown for illustrative purposes only, and are not meant to limit the scope of the present disclosure to any specific antenna configuration shown.

In FIGS. 5A and 5B, a first monopole element 330.2 is coupled to Port 1, and a second monopole element 332.2 is coupled to Port 2. A grounding strip 322.2 couples a ground plane 320.2 to a shared grounding structure 310.2, which is capacitively coupled to both first and second monopole elements 330.2 and 332.2. The grounding structure 310.2 includes a first branch 310.2*a* (capacitively coupled to first monopole element 330.2) conductively coupled to a second branch 310.2*b* (capacitively coupled to second monopole element 332.2) via a short connecting strip 511. Note the grounding structure 310.2 may extend in multiple dimensions (e.g., along the X-, Y-, and Z-axes), and may be extensively patterned to, e.g., optimize the antenna performance according to the requirements of the design.

In the exemplary embodiment shown, the connecting strip 511 is provided adjacent to the grounding strip 322.2, e.g., the connecting strip 511 and the grounding strip 322.2 have X-coordinates (referring to the X axis as indicated in FIG. 5A) that are relatively close to each other given the overall dimensions of the antenna 301.2. It will be appreciated that the connecting strip 511 conductively couples the two grounding branches 310.2*a* and 310.2*b* of the monopole elements to each other, thus enlarging the effective antenna size of each monopole antenna (e.g., wherein each monopole antenna is characterized by the joint size of a monopole element and its associated grounding branch).

In FIGS. 5A and 5B, the shape of the first branch 310.2*a* illustratively includes a patterned formation characterized by, e.g., stubs and lines that capacitively couple to the first monopole element 330.2 along three sides (e.g., along the X-, Y-, and Z-axes). The shape of the second branch 310.2*b* illustratively includes a patterned formation characterized by, e.g., a conductive line that capacitively couples to the second monopole element 332.2 along the Y-axis.

It will be appreciated that the shapes of the first branch 310.2*a* and the second branch 310.2*b* of the grounding structure 310.2 are shown for illustrative purposes only, and are not meant to limit the scope of the present disclosure. In alternative exemplary embodiments, the grounding structure 310.2 need not be patterned as illustratively shown in FIGS. 5A, 5B, or as shown in other figures herein. Rather, the grounding structure 310.2 may have a simple profile, e.g., a straight rectangular conductive element such as shown in FIG. 4, etc., or any arbitrary profile. Such alternative exemplary embodiments are contemplated to be within the scope of the present disclosure.

It is noted that providing the extremities of the two branches 310.2*a*, 310.2*b* away from each other may advantageously result in less coupling between Port 1 and Port 2. Accordingly, the two ends of the grounded branches 310.2*a* and 310.2*b* may be provided adjacent opposite sides Side A and Side B of the apparatus 500.

It will further be appreciated that, by optimally choosing the feeding structure (e.g., elements 330.2 and 332.2), connecting point 511, and the shorting locations (e.g., the position along the Y-axis of element 322.2), isolation between the two monopole antenna elements may be enhanced, or otherwise optimized according to the design requirements.

Figure 6A:
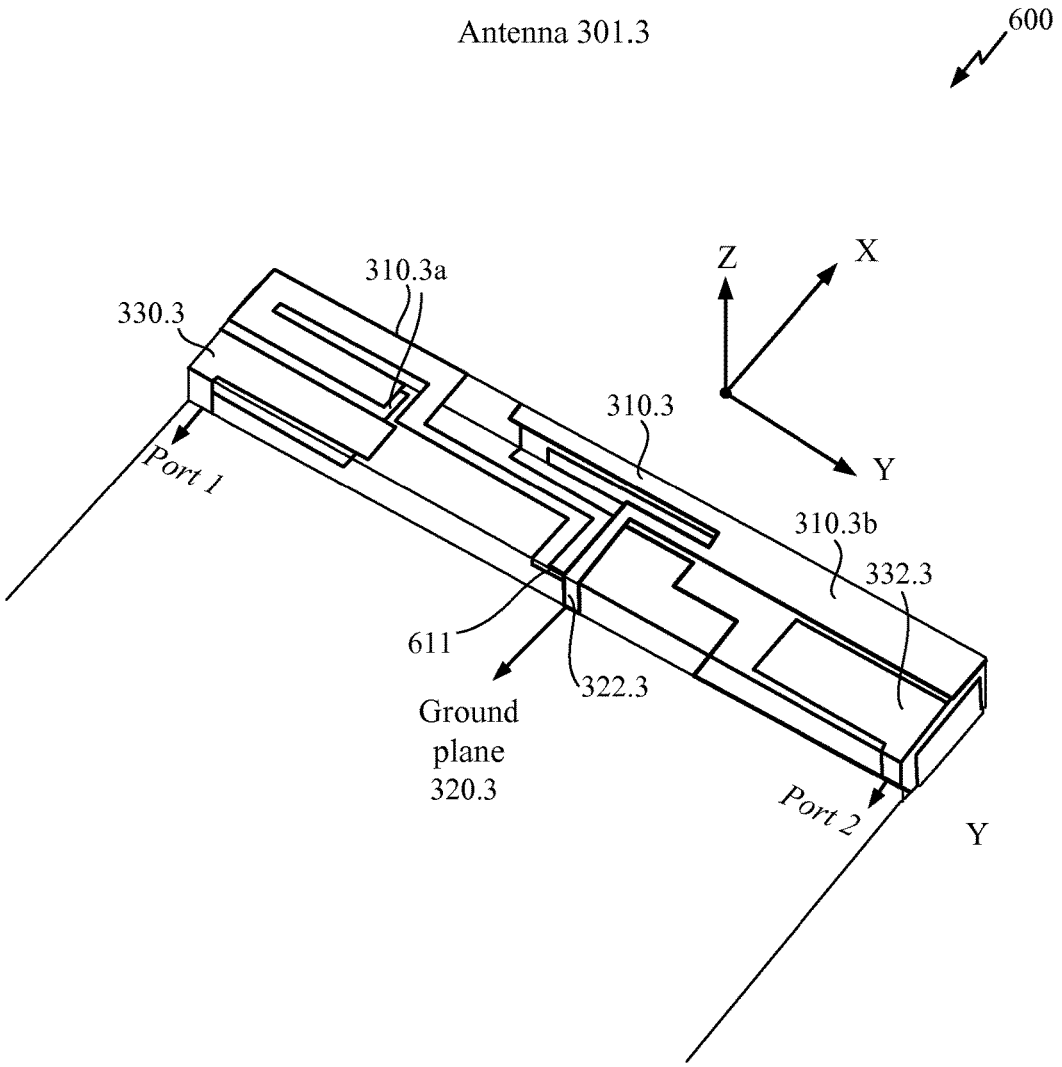
FIGS. 6A, 6B, and 6C illustrate perspective views of an alternative exemplary embodiment of an antenna according to the present disclosure.
Figure 6B:
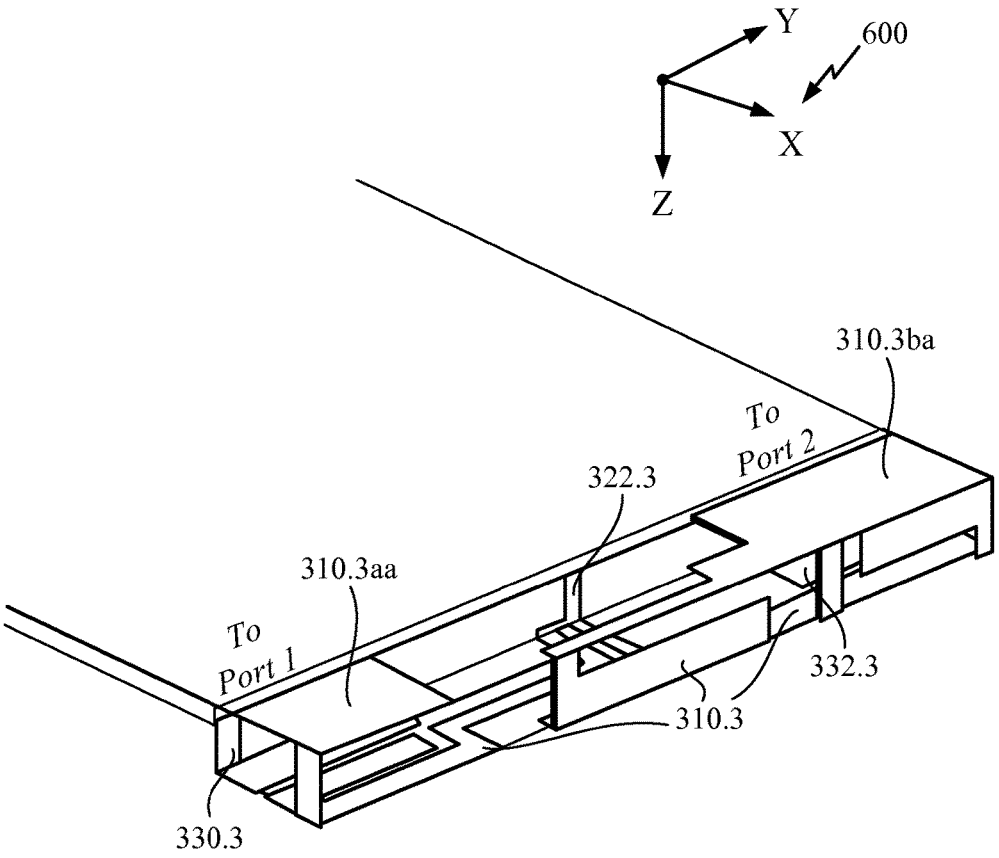
Figure 6C:
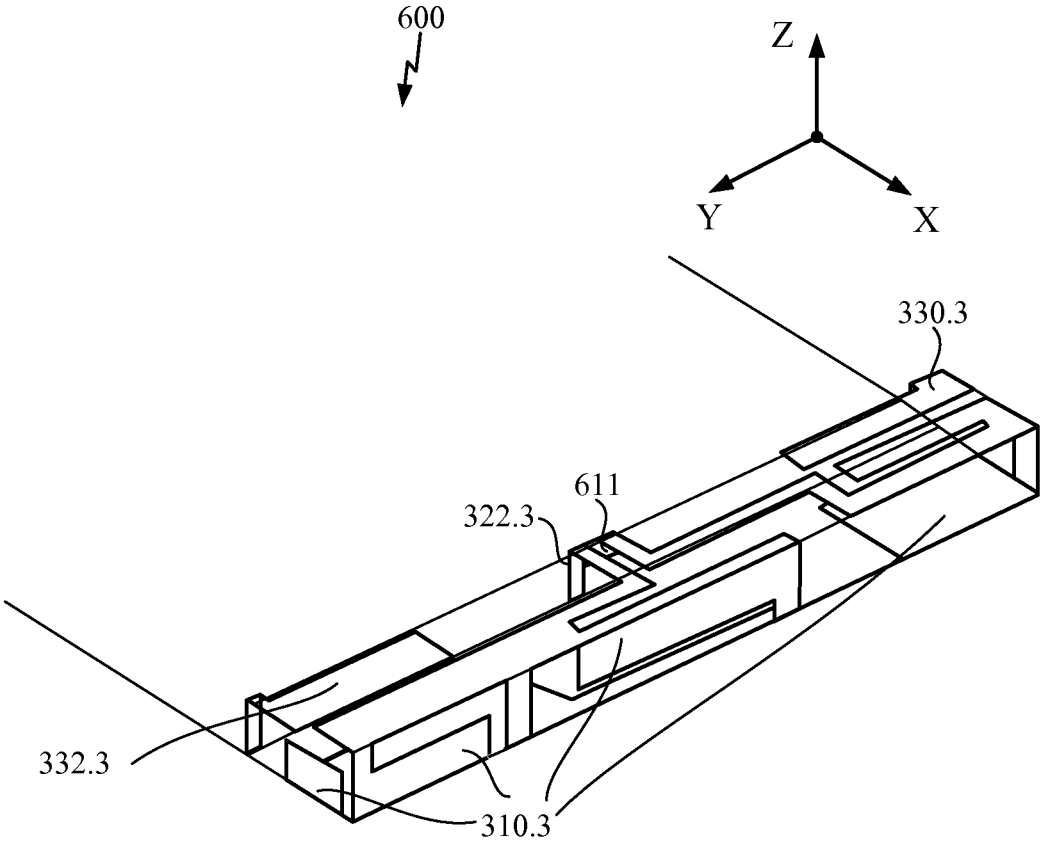

FIGS. 6A, 6B, and 6C illustrate perspective views of an alternative exemplary embodiment of an apparatus 600 incorporating an antenna 301.3 according to the present disclosure. Note FIGS. 6A, 6B, and 6C are shown for illustrative purposes only, and are not meant to limit the scope of the present disclosure.

In particular, a first monopole element 330.3 is coupled to Port 1, and a second monopole element 332.3 is coupled to Port 2. A grounding strip 322.3 couples a ground plane 320.3 to a shared grounding structure 310.3, which is capacitively coupled to both first and second monopole elements 330.3 and 332.3. The grounding structure 310.3 includes a first branch 310.3*a* (capacitively coupled to first monopole element 330.3) conductively coupled to a second branch 310.3*b* (capacitively coupled to second monopole element 332.3) via a short connecting strip 611. In the exemplary embodiment shown, the connecting strip 611 is provided adjacent to the connection between the grounding strip 322.3 and the shared grounding structure 310.3.

It will be appreciated that the patterned shapes of the first branch 310.3*a* and second branch 310.3*b* of the grounding structure 310.3 are shown for illustrative purposes only, and are not meant to limit the scope of the present disclosure. As may be seen more clearly in FIG. 6B, which shows a perspective view wherein the rear surface of the apparatus 600 is shown facing up (as may be noted from the directionality of the Z the axis shown), the grounding element 310.3 includes a relatively large surface 310.3*aa* that covers the area opposite the first monopole element 330.3 on the bottom side of the substrate 212. Furthermore, the grounding element 310.3 includes a relatively large surface 310.3*ba* that covers the area opposite the second monopole element 332.3 on the bottom side of the substrate 212.

Figure 7:
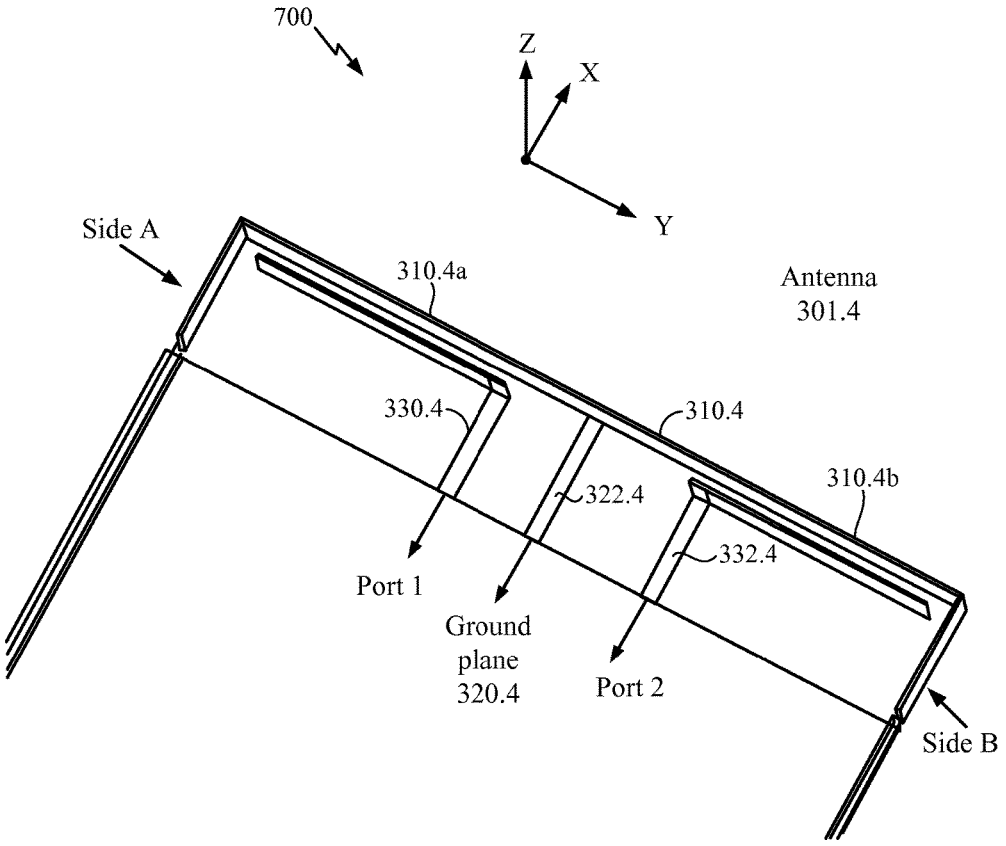
FIG. 7 illustrates an alternative exemplary embodiment of an antenna.

According to certain exemplary embodiments, connections between the monopole elements and their respective driving ports need not be provided at opposing sides of an apparatus supporting the antenna structure. For example, FIG. 7 illustrates an alternative exemplary embodiment of an apparatus 700 incorporating an antenna 301.4. In FIG. 7, a first monopole element 330.4 is coupled to Port 1, and a second monopole element 332.4 is coupled to Port 2. A grounding strip 322.4 couples a ground plane 320.4 to a shared grounding structure 310.4, which is capacitively coupled to both first and second monopole elements 330.4 and 332.4. The grounding structure 310.4 includes a first branch 310.4*a*(capacitively coupled to first monopole element 330.4) conductively coupled to a second branch 310.4*b* (capacitively coupled to second monopole element 332.4).

In the exemplary embodiment 301.4, the connection of first monopole element 330.4 to Port 1 and the connection of second monopole element 332.4 to Port 2 are provided away from the sides (Side A and Side B) of the apparatus 700 housing the antenna 301.4. In particular, the connections of the monopole elements to Ports 1 or 2 are closer to the grounding strip 322.4 along the Y axis.

Figure 8:
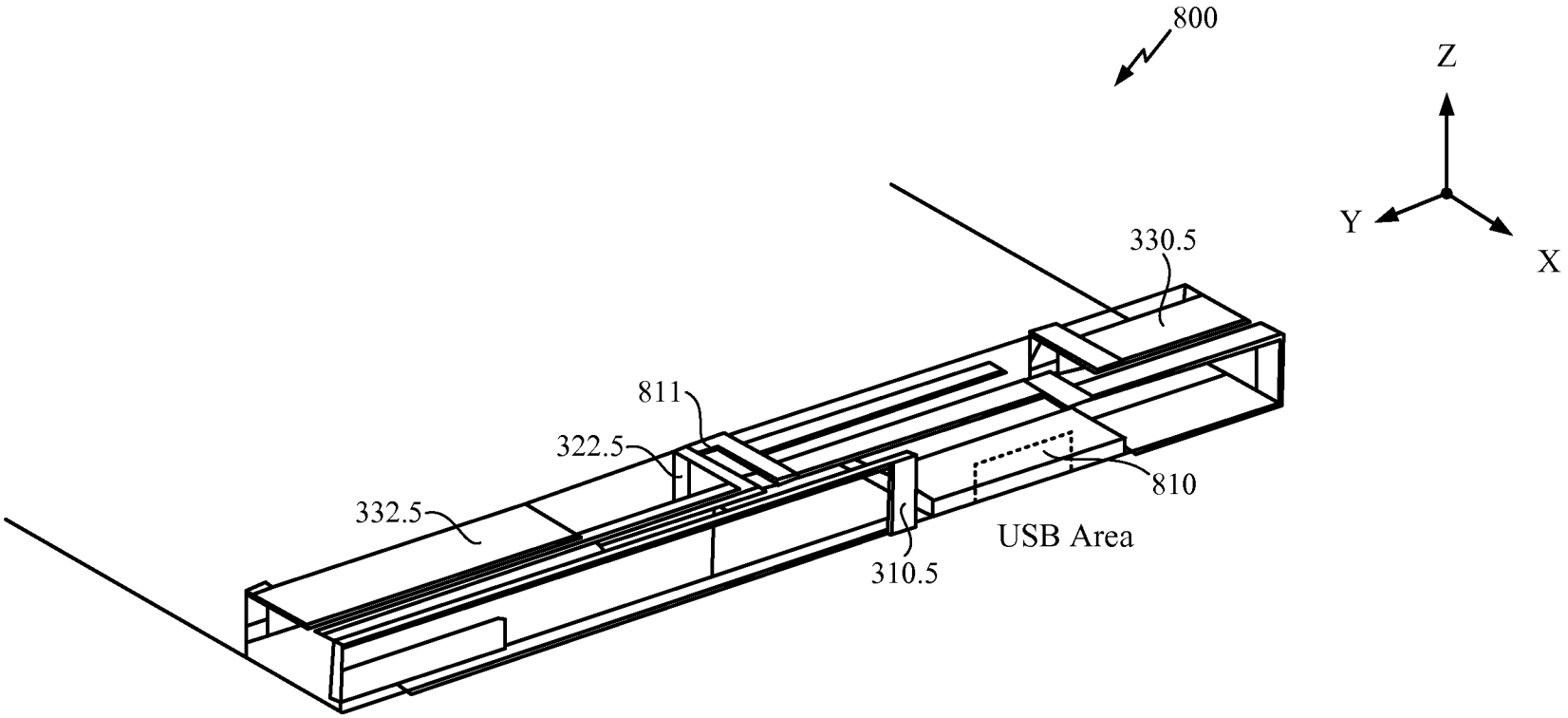
FIG. 8 illustrates an alternative exemplary embodiment of the present disclosure, wherein antenna techniques of the present disclosure are integrated with techniques for accommodating additional modules of the apparatus.

FIG. 8 illustrates an alternative exemplary embodiment of the present disclosure, wherein antenna techniques of the present disclosure are integrated with techniques for accommodating additional modules of the apparatus 800. Note FIG. 8 is shown for illustrative purposes only, and is not meant to limit the scope of the present disclosure. It will be appreciated that the functionality of certain elements of FIG. 8 will be clear in view of the preceding description, and the description of such functionality may accordingly be omitted hereinbelow for ease of discussion.

In FIG. 8, apparatus 800 includes an area 810 that would otherwise be occupied by substrate 212 supporting elements of the antenna 301.5. The area 810 represents a hollowed-out portion of the substrate 212, wherein additional modules of the apparatus 800 may be provided. For example, a microphone, speaker, USB connector, etc., may thus be integrated in the same area of the apparatus 800 occupied by the antenna 301.5. In certain exemplary embodiments, some degradation in the antenna performance may result when such additional components are inserted into the antenna space in this manner. However, it will be appreciated that such degradation may be tolerated as a design trade-off in certain applications.

Figure 9:
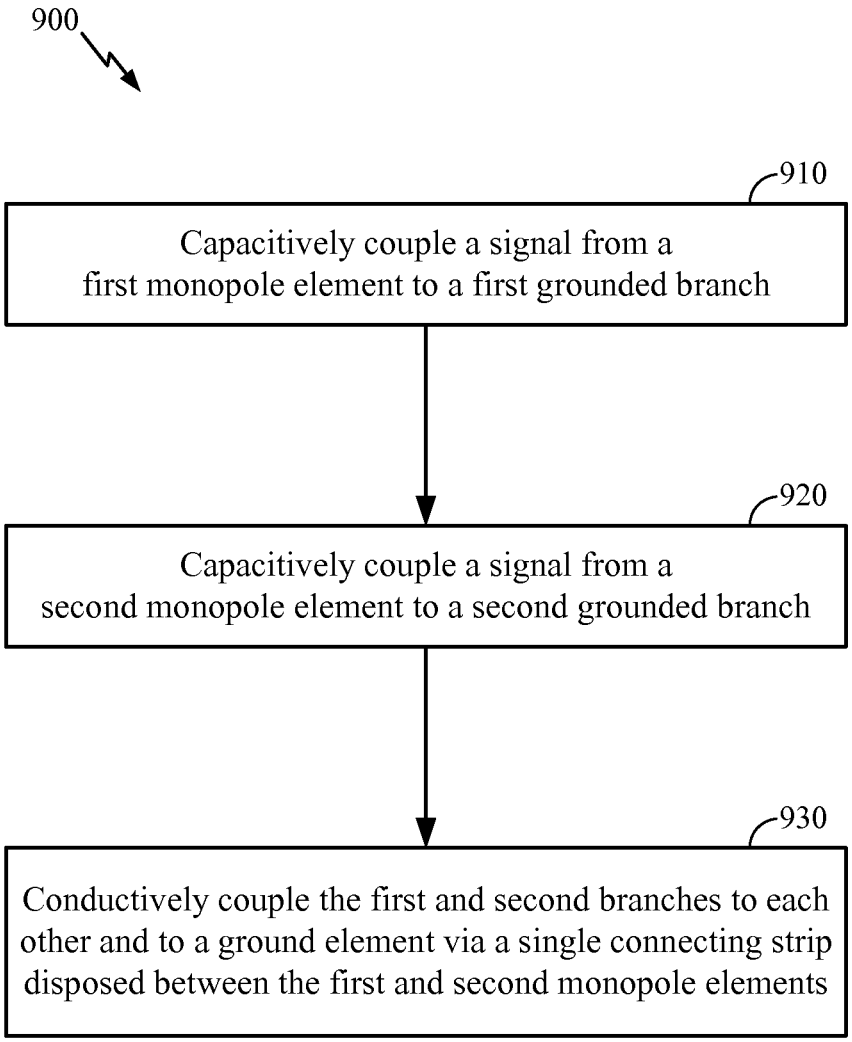
FIG. 9 illustrates an exemplary embodiment of a method according to the present disclosure.

FIG. 9 illustrates an exemplary embodiment of a method 900 according to the present disclosure. Note the method 900 is shown for illustrative purposes only, and is not meant to limit the scope of the present disclosure.

In FIG. 9, at block 910, a signal is capacitively coupled from a first monopole element to a first grounded branch.

At block 920, a signal is capacitively coupled from a second monopole element to a second grounded branch.

At block 930, the first and second branches are conductively coupled to each other and to a ground element via a single connecting strip disposed between the first and second monopole elements.

Note while illustrative configurations have been enumerated and described for the grounding structure 310, e.g., including a relatively short grounding strip 322 and two branches 310*a*, 310*b*, alternative exemplary embodiments may generally adopt any shape for the grounded element that maintains shared capacitive coupling to both the first monopole antenna element 330 and second monopole antenna element 332. Furthermore, while the branches 310*a*, 310*b* have been illustrated as in certain figures herein as including a patterned conductive design, in alternative exemplary embodiments, the patterned designs shown may be replaced by unpatterned shapes, e.g., an unpatterned conducting sheet (e.g., having a simple rectangular shape, etc.). Such alternative exemplary embodiments are contemplated to be within the scope of the present disclosure.

It will be appreciated that the techniques of the present disclosure may be applicable to different phone platforms, e.g., 5-inch phones, small phones, thin phones, etc. For example, in certain exemplary embodiments, broadband antennas with dimensions of greater or lesser size may be designed according to the techniques disclosed. Furthermore, techniques of the present disclosure are not limited to the two-antenna module. For example, tri-fed and quad-fed antenna modules may also be designed. For example, additional feeding and radiating structures (e.g., beyond the two monopole elements described hereinabove) may be provided which nevertheless share a single common grounding structure. Such alternative exemplary embodiments are contemplated to be within the scope of the present disclosure.

In this specification and in the claims, it will be understood that when an element is referred to as being "connected to" or "coupled to" another element, it can be directly connected or coupled to the other element or intervening elements may be present. In contrast, when an element is referred to as being "directly connected to" or "directly coupled to" another element, there are no intervening elements present. Furthermore, when an element is referred to as being "electrically coupled" to another element, it denotes that a path of low resistance is present between such elements, while when an element is referred to as being simply "coupled" to another element, there may or may not be a path of low resistance between such elements.

Those of skill in the art would understand that information and signals may be represented using any of a variety of different technologies and techniques. For example, data, instructions, commands, information, signals, bits, symbols, and chips that may be referenced throughout the above description may be represented by voltages, currents, electromagnetic waves, magnetic fields or particles, optical fields or particles, or any combination thereof.

Those of skill in the art would further appreciate that the various illustrative logical blocks, modules, circuits, and algorithm steps described in connection with the exemplary aspects disclosed herein may be implemented as electronic hardware, computer software, or combinations of both. To clearly illustrate this interchangeability of hardware and software, various illustrative components, blocks, modules, circuits, and steps have been described above generally in terms of their functionality. Whether such functionality is implemented as hardware or software depends upon the particular application and design constraints imposed on the overall system. Skilled artisans may implement the described functionality in varying ways for each particular application, but such implementation decisions should not be interpreted as causing a departure from the scope of the exemplary aspects of the invention.

The various illustrative logical blocks, modules, and circuits described in connection with the exemplary aspects disclosed herein may be implemented or performed with a general purpose processor, a Digital Signal Processor (DSP), an Application Specific Integrated Circuit (ASIC), a Field Programmable Gate Array (FPGA) or other programmable logic device, discrete gate or transistor logic, discrete hardware components, or any combination thereof designed to perform the functions described herein. A general purpose processor may be a microprocessor, but in the alternative, the processor may be any conventional processor, controller, microcontroller, or state machine. A processor may also be implemented as a combination of computing devices, e.g., a combination of a DSP and a microprocessor, a plurality of microprocessors, one or more microprocessors in conjunction with a DSP core, or any other such configuration.

The steps of a method or algorithm described in connection with the exemplary aspects disclosed herein may be embodied directly in hardware, in a software module executed by a processor, or in a combination of the two. A software module may reside in Random Access Memory (RAM), flash memory, Read Only Memory (ROM), Electrically Programmable ROM (EPROM), Electrically Erasable Programmable ROM (EEPROM), registers, hard disk, a removable disk, a CD-ROM, or any other form of storage medium known in the art. An exemplary storage medium is coupled to the processor such that the processor can read information from, and write information to, the storage medium. In the alternative, the storage medium may be integral to the processor. The processor and the storage medium may reside in an ASIC. The ASIC may reside in a user terminal. In the alternative, the processor and the storage medium may reside as discrete components in a user terminal.

In one or more exemplary aspects, the functions described may be implemented in hardware, software, firmware, or any combination thereof. If implemented in software, the functions may be stored on or transmitted over as one or more instructions or code on a computer-readable medium. Computer-readable media includes both computer storage media and communication media including any medium that facilitates transfer of a computer program from one place to another. A storage media may be any available media that can be accessed by a computer. By way of example, and not limitation, such computer-readable media can comprise RAM, ROM, EEPROM, CD-ROM or other optical disk storage, magnetic disk storage or other magnetic storage devices, or any other medium that can be used to carry or store desired program code in the form of instructions or data structures and that can be accessed by a computer. Also, any connection is properly termed a computer-readable medium. For example, if the software is transmitted from a website, server, or other remote source using a coaxial cable, fiber optic cable, twisted pair, digital subscriber line (DSL), or wireless technologies such as infrared, radio, and microwave, then the coaxial cable, fiber optic cable, twisted pair, DSL, or wireless technologies such as infrared, radio, and microwave are included in the definition of medium. Disk and disc, as used herein, includes compact disc (CD), laser disc, optical disc, digital versatile disc (DVD), floppy disk and Blu-Ray disc where disks usually reproduce data magnetically, while discs reproduce data optically with lasers. Combinations of the above should also be included within the scope of computer-readable media.

The previous description of the disclosed exemplary aspects is provided to enable any person skilled in the art to make or use the invention. Various modifications to these exemplary aspects will be readily apparent to those skilled in the art, and the generic principles defined herein may be applied to other exemplary aspects without departing from the spirit or scope of the invention. Thus, the present disclosure is not intended to be limited to the exemplary aspects shown herein but is to be accorded the widest scope consistent with the principles and novel features disclosed herein.

The invention claimed is:

1. An apparatus comprising:

a first monopole element;

a second monopole element, wherein at least one of the first monopole element or the second monopole element is conductively ungrounded;

a common structure comprising a first branch and a second branch, the first branch capacitively coupled to the first monopole element to form a first monopole antenna and the second branch capacitively coupled to the second monopole element to form a second monopole antenna, wherein the first branch is coupled to the second branch at a connecting point located between the first and second branches; and a connecting strip configured to conductively couple the common structure to a ground element, wherein the connecting strip is coupled to the connecting point, and wherein the first and second branches and the first and second monopole elements are elongated substantially parallel to a line oriented perpendicular to the connecting strip.

2. The apparatus of claim 1, further comprising a board, wherein the first monopole element is disposed adjacent to a first edge of the board, and wherein the second monopole element is disposed adjacent to a second edge of the board, the second edge opposite of the first edge.

3. The apparatus of claim 1, wherein the first monopole element, the second monopole element, and the common structure are disposed adjacent to a substrate.

4. The apparatus of claim 1, at least one of the first branch and the second branch comprising a patterned conductive element.

5. The apparatus of claim 3, the substrate comprising an FR4 substrate.

6. The apparatus of claim 1, the first monopole element coupled by a first short conductive strip to a first driving port, and the second monopole element coupled by a second short conductive strip to a second driving port.

7. The apparatus of claim 6, wherein a first plane aligned with surfaces of the first short conductive strip, the second short conductive strip, and the connecting strip is perpendicular to a second plane aligned with surfaces of the first monopole element and the second monopole element.

8. The apparatus of claim 7, wherein a surface of a first portion of the common structure is aligned with the first plane, and wherein a surface of a second portion of the common structure is aligned with the second plane.

9. The apparatus of claim 1, wherein a size of the common structure is substantially larger than a size of the first monopole element and a size of the second monopole element.

10. The apparatus of claim 3, further comprising a component disposed within a hollowed-out portion of the substrate, wherein the component comprises a universal serial bus (USB) connector.

11. The apparatus of claim 1, wherein the first branch of the common structure is capacitively coupled to the first monopole element and the second branch is capacitively coupled to the second monopole element.

12. An apparatus comprising:

means for capacitively coupling a first monopole element to a first branch of a common structure forming a first monopole antenna;

means for capacitively coupling a second monopole element to a second branch of the common structure forming a second monopole antenna, wherein at least one of the first monopole element or the second monopole element is conductively ungrounded; and means for conductively coupling a ground element to a connecting point disposed between the first and second branches of the common structure, wherein the first monopole element, the second monopole element, the first branch, and the second branch are disposed adjacent to a substrate and elongated substantially parallel to a line oriented perpendicular to the means for conductively coupling.

13. The apparatus of claim 12, further comprising means for driving the first monopole element and the second monopole element according to a one port excitation scheme.

14. The apparatus of claim 12, at least one of the first branch and the second branch comprising a patterned conductive element.

15. The apparatus of claim 12, wherein the means for conductively coupling includes a connecting strip coupled the ground element, the first branch, and the second branch.

16. A method comprising:

receiving a first signal from a first driving port at a first monopole antenna comprising a first monopole element capacitively coupled to a first branch of a common structure; and receiving a second signal from a second driving port at a second monopole antenna comprising a second monopole element capacitively coupled to a second branch of the common structure, wherein at least one of the first monopole element or the second monopole element is conductively ungrounded, wherein the first branch is coupled to the second branch at a connecting point located between the first and second branch, wherein a connecting strip conductively couples the connecting point to a ground element, and wherein the first and second branches and the first and second monopole elements are elongated substantially parallel to a line oriented perpendicular to the connecting strip.

17. The method of claim 16, further comprising driving the first monopole element and the second monopole element according to a one port excitation scheme, wherein the one port excitation scheme includes driving only one of the first monopole element and the second monopole element at a time.

18. The apparatus of claim 1, wherein a first edge of the connecting strip is in contact with the common structure, and wherein a second edge of the connecting strip is in contact with the ground element.

19. The apparatus of claim 6, wherein the ground element is disposed adjacent to a substrate.

20. The apparatus of claim 1, wherein the common structure is adjacent to the first monopole element along three sides of the first monopole element.

* * * * *